US007201303B2

(12) United States Patent
Leimbach

(10) Patent No.: US 7,201,303 B2
(45) Date of Patent: Apr. 10, 2007

(54) CORDLESS FASTENER DRIVING TOOL

(75) Inventor: Richard L. Leimbach, Cincinnati, OH (US)

(73) Assignee: Senco Products, Inc., Cincinnati, OH (US)

( * ) Notice: Subject to any disclaimer, the term of this patent is extended or adjusted under 35 U.S.C. 154(b) by 0 days.

(21) Appl. No.: 11/117,235

(22) Filed: Apr. 28, 2005

(65) Prior Publication Data

US 2005/0242154 A1 Nov. 3, 2005

Related U.S. Application Data

(60) Provisional application No. 60/567,263, filed on Apr. 30, 2004.

(51) Int. Cl.
*B25C 1/06* (2006.01)
*B25C 1/18* (2006.01)
*B25C 1/12* (2006.01)

(52) U.S. Cl. ..... 227/131; 227/120; 227/133

(58) Field of Classification Search ..... 227/133, 227/120, 131, 146; 173/13, 15, 122, 124, 173/216, 217; 74/24, 84 R, 436, 820
See application file for complete search history.

(56) References Cited

U.S. PATENT DOCUMENTS 2,597,950 A * 5/1952 Robertson ..... 74/436
3,278,106 A 10/1966 Becht et al.
4,403,722 A 9/1983 Nikolich
4,724,992 A * 2/1988 Ohmori ..... 227/146
4,953,774 A * 9/1990 Lai ..... 227/131
5,118,023 A * 6/1992 Fushiya et al. ..... 227/8
5,320,270 A 6/1994 Crutcher
5,511,715 A * 4/1996 Crutcher et al. ..... 227/131
5,720,423 A * 2/1998 Kondo et al. ..... 227/130
6,607,111 B2 8/2003 Garvis et al.
6,669,072 B2 12/2003 Burke et al.

* cited by examiner

*Primary Examiner*—Rinaldi I. Rada
*Assistant Examiner*—Nathaniel Chukwurah
(74) *Attorney, Agent, or Firm*—Jerrold J. Litzinger

(57) ABSTRACT

The present invention teaches a unique drive mechanism for use in a hand held fastener driving tool. The driving mechanism comprises a pair of opposing cams coaxially positioned upon a common shaft. One of the cams is motor driven and rotatable about the common shaft but not axially translatable while the other cam is axially translatable but non-rotatable. Rotation of the rotatable cam by the motor causes the non-rotatable axially translatable cam to compress a compressible spring assembly, storing potential energy therein. Simultaneously, a driver activation cable, wrapped about the rotatable cam's periphery, unwraps thereby raising a fastener driver to its driving configuration. Upon release of the rotatable cam from the motor drive, the potential energy stored within the spring assembly causes reverse rotation of the rotatable cam thereby rewinding the drive cable about the rotatable cam's periphery and driving the fastener driver, whereby the driver drives a fastener into a workpiece.

26 Claims, 10 Drawing Sheets

CORDLESS FASTENER DRIVING TOOL

CROSS REFERENCE TO RELATED APPLICATIONS

This application claims benefit from U.S. Provisional Patent Application Ser. No. 60/567,263, filed Apr. 30, 2004, which application is incorporated herein by reference.

BACKGROUND OF THE INVENTION

1. Field of the Invention

This invention relates generally to fastener driving tools, in particular, to a battery operated fastener driving tool which uses the energy stored in a spring to drive the fastener.

2. Description of the Related Art

Many different types of tools have been developed over the years for the purpose of driving a fastener into wood. The most common type of fastener driving tool is the type in which the driver is actuated pneumatically. An example of this type of tool is shown in U.S. Pat. No. 3,278,106. While these tools work well, one drawback to their use is the requirement of a compressor to provide the pneumatic power.

In recent times, other designs for fastener driving tools have used electromechanical designs to provide the energy necessary to drive the fasteners. Some of these tools use a heavy duty solenoid to provide the driving force. Others employ the use of one or more flywheels to generate the necessary driving force. While these types of tools have been successful, it is necessary to use an electrical cord, instead of a pneumatic hose, to supply the driving power.

An alternative design has become popular which uses internal combustion to provide the motive force, thus allowing the tools to become truly portable, with no hose or cord necessary for the operation of the tool. An example of this type of tool is taught in U.S. Pat. No. 4,403,722. Although this type of tool has been successful, some drawbacks have been associated with internal combustion tools. First, the expense for operating these tools is higher than the pneumatic and electrical tools; in addition, the exhaust fumes from these tools can be bothersome when working in an enclosed area.

Some newer electric tools have been designed such that they can be operated using batteries. Examples of these types of tools can be seen in U.S. Pat. Nos. 6,607,111 and 6,669,072. When used with rechargeable batteries, theses tools are portable and can be operated at minimal cost. However, these tools are necessarily bulky and heavy, as they require high energy mechanisms to drive the fasteners.

U.S. Pat. No. 5,720,423 teaches a fastener driving tool which uses a drive piston within a gas chamber in which the piston is moved in a direction opposite the driving direction within the gas chamber to compress the gas above the piston such that the piston drives a fastener when released as a result of the compressed air. However, the size of this tool is dictated by the length of the gas chamber, as the gas must be compressed significantly to generate the force needed to drive larger fasteners, and it is also necessary to include an air replenishing tank to supply compressed air to the chamber when the pressure drops below a predetermined value.

Finally, other tools use linear compression springs as an energy storage device to provide the driving force needed to drive a fastener into a substrate. These springs do not adapt efficiently in a chamber to create a sufficient force to drive larger fasteners, and the springs generally do not have proper duty cycles, leading to premature failure.

SUMMARY OF THE INVENTION

It is therefore an object to the present invention to provide a fastener driving tool of simple construction which is compact and reliable.

It is a further object of the present invention to provide a battery powered fastener driving tool which needs no connection to an external power source.

It is a still further object of the present invention to provide a fastener driving tool which uses stored energy to efficiently drive small gauge fasteners into a workpiece.

These and other objects of the present invention are accomplished by a novel fastener driving tool which comprises a pair of opposed ball ramp cams positioned on a common axial shaft. One cam is rotatable about the axial shaft while the opposing cam is non-rotatable but is axially shiftable on the shaft. A motor driven mechanism rotates the rotatable cam, causing axial separation of the opposing cams, and compressing an energy storing device which is positioned on the shaft to store potential energy within the device. As the rotatable cam is released, the energy storing device forces the non-rotatable cam back to its starting position, and the balls on the ramps of the cams cause the rotatable cam to rotate in the reverse direction, causing a driver blade to drive a fastener from the tool.

DETAILED DESCRIPTION OF THE PREFERRED EMBODIMENTS

Figure 1:
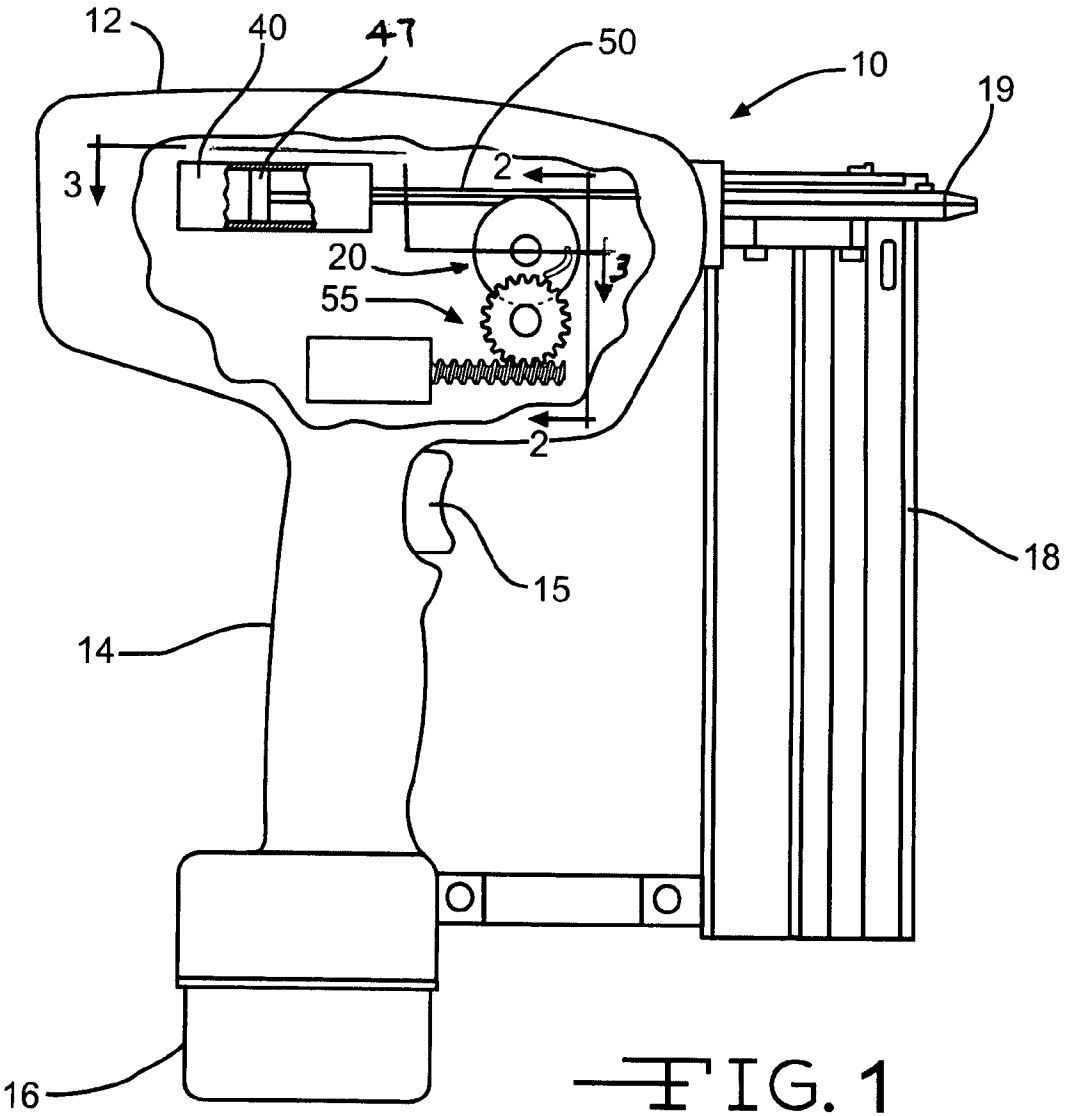
FIG. 1 is a fragmentary side elevational view of an exemplary fastener driving tool according to the present invention.

FIG. 1 illustrates a typical battery powered hand held fastener driving tool generally indicated at 10 comprising a main body or housing 12, handle 14 including activation trigger 15, a battery pack 16, and a fastener magazine 18 including a typical guide body 19. Main body 12 is shown having a portion of its side removed, thereby showing the general arrangement of the principal subassemblies of the tool's working mechanism in accordance with the present invention.

Figure 2:
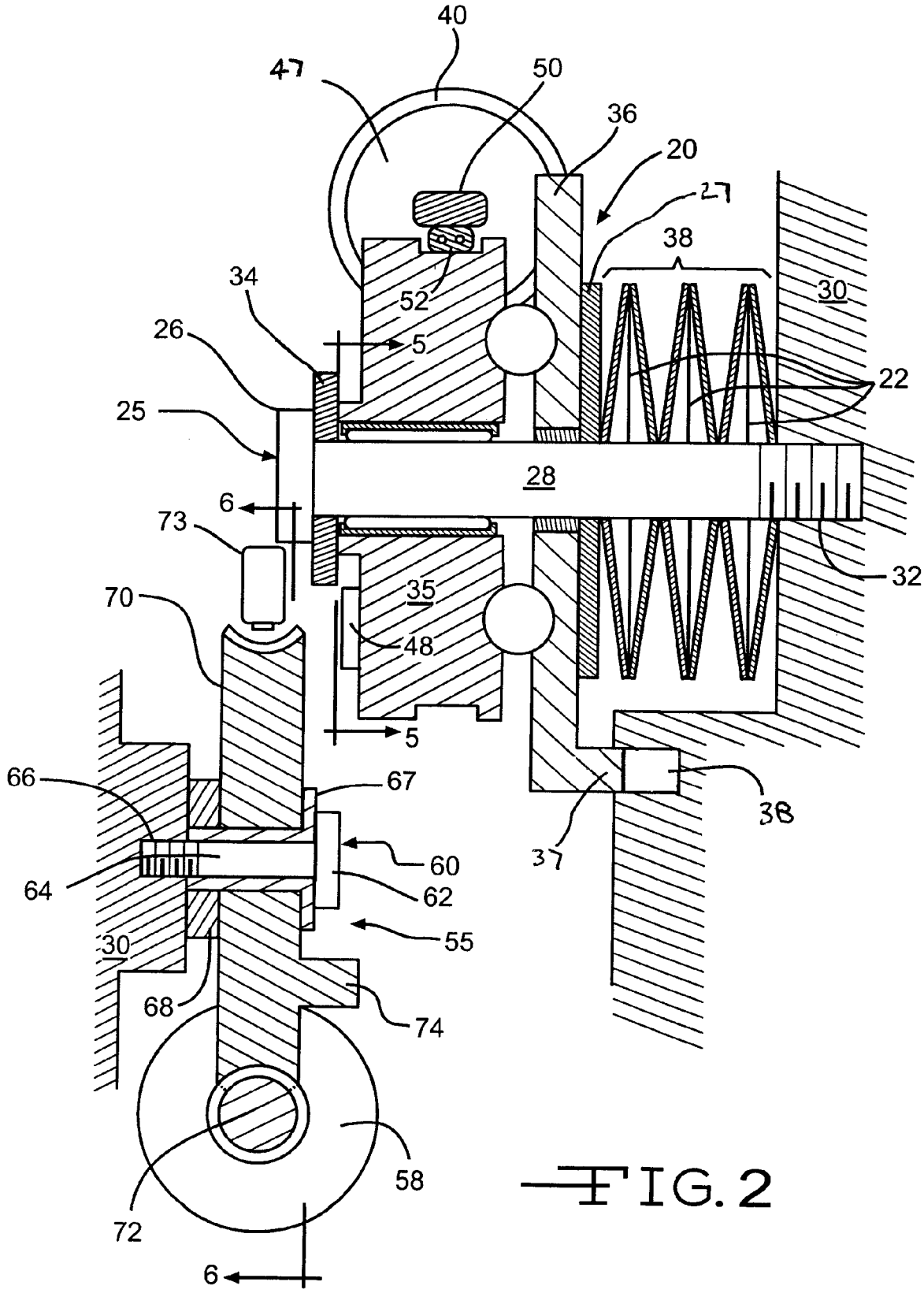
FIG. 2 is a cross-sectional view taken along section line 2—2 of FIG. 1 showing the principal working elements of the invention.
Figure 4:
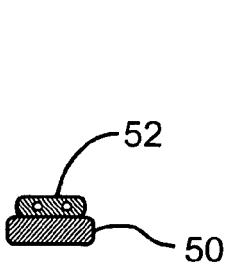
FIG. 4 is a cross-sectional view taken along section line 4—4 of FIG. 3.
Figure 3:
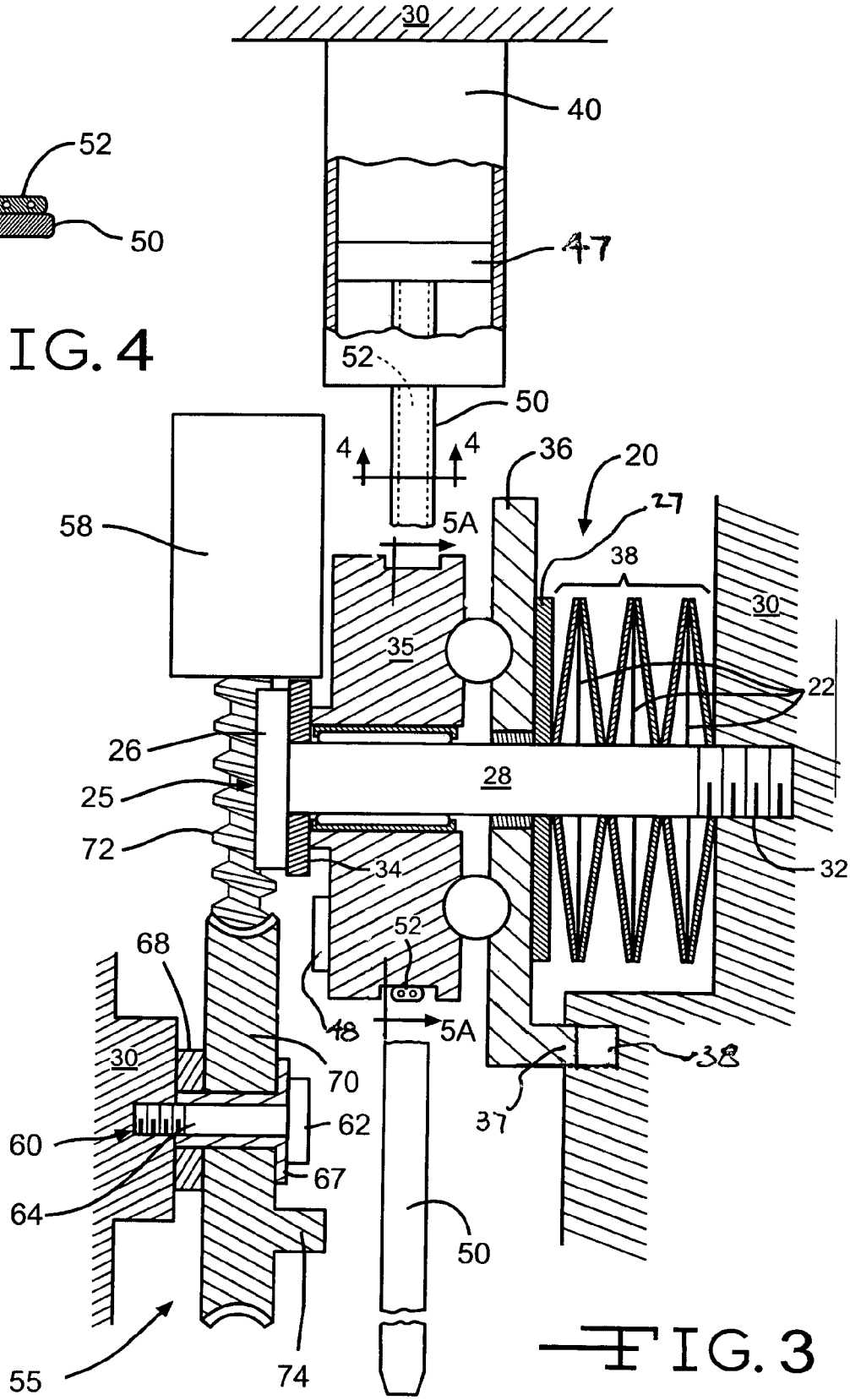
FIG. 3 is a cross-sectional view, taken along section line 3—3 of FIG. 1.

Referring now to FIGS. 2 and 3, the primary working mechanism comprises two major subassemblies, a fastener driving subassembly generally indicated at 20, and a motor/gear subassembly generally indicated at 55.

Fastener driving subassembly 20 comprises a central axial pin indicated at 25 having a head end 26 and an elongated shaft portion 28 rigidly affixed to a frame 30 of tool main body 12 by screw threads 32, or any other convenient means.

Assembled coaxially upon axial pin 25, between pin head end 26 and main body frame 30, is a rotatable cam 35, a non-rotatable fixed cam 36 and a compressible spring means 38. Although compressible spring means 38 is illustrated in the drawings as comprising a stack of oppositely facing Belleville spring washers 22, spring means 38 may alternately comprise a coil spring or any other suitable compressible potential energy storing system that will store potential energy when compressed. A thrust washer 34 is positioned between axial pin head 26 and rotatable cam 35. Rotatable cam 35 contains a channel 26 within its periphery. Finally, a spacer 27 is positioned between cam 36 and Belleville spring washer stack 22.

Figure 8:
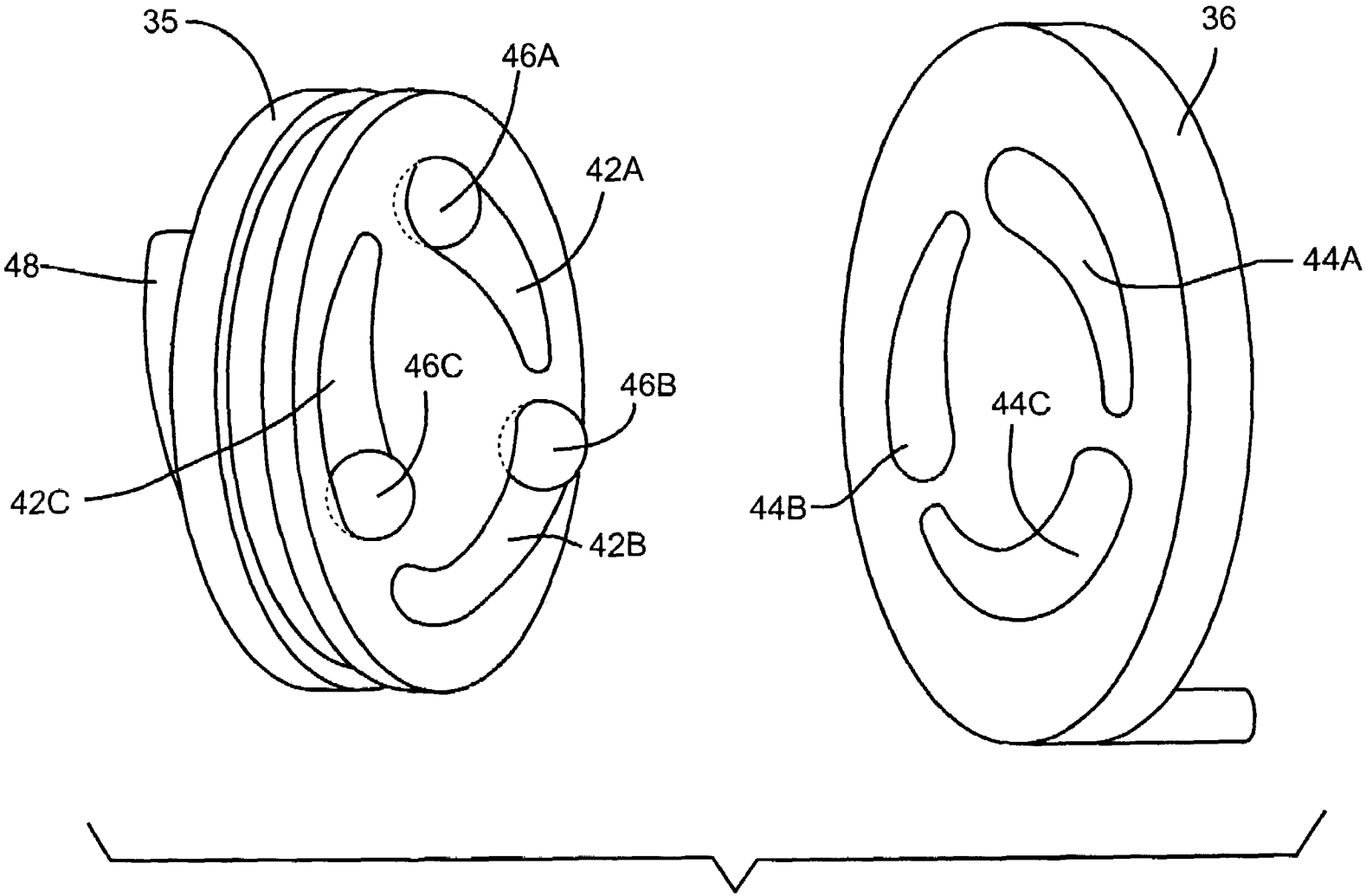
FIG. 8 is a perspective view of the fixed cam and the rotatable cam of the present invention.

As illustrated in FIG. 8, the opposing surfaces of rotatable cam 35 and non-rotatable cam 36 include three ball ramps 42A, 42B, 42C, and 44A, 44B, and 44C respectively. Positioned between the opposing ball ramps are three ball bearings 46A, 46B, and 46C. As cam 35 rotates with respect to fixed cam 36, ball bearings 46 move within the opposing ball ramps 42 and 44, thereby causing non-rotatable cam 36 to move away from rotatable cam 35. Cam 36 is held in position against rotation by an extension 37 which is captured within an opening 38 within frame 30.

Figure 5A:
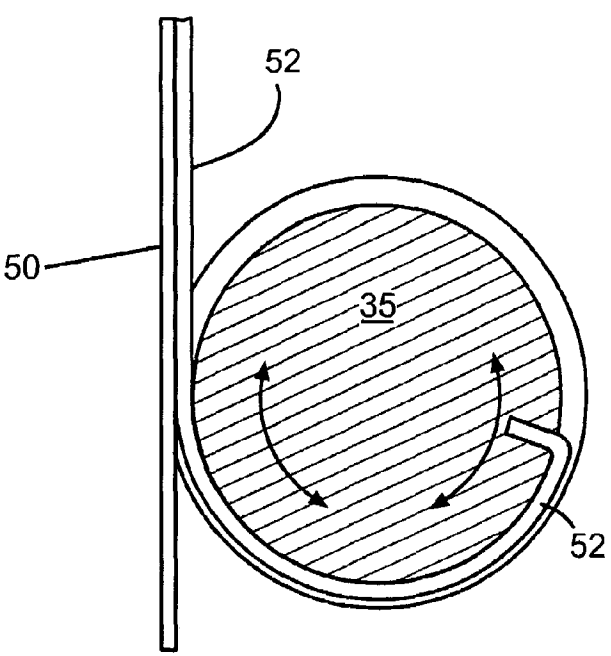
FIG. 5A is a cross-sectional view taken along section line 5A—5A of FIG. 3.

Typically received within a fixed piston tube 40 (FIG. 3) is a driving piston 47. A rigid elongated fastener driver 50 is provided, having one end thereof affixed to driving piston 47 within driving tube 40. A driver activating cable 52 having one end thereof affixed to driving piston 47 and the other end thereof affixed within channel 26 on the periphery of rotatable cam 35 such that when fastener driver 50 is in its rest or start position, as can be clearly seen in FIG. 5A, driver activating cable 52 is partially wrapped within channel 26 on the periphery of rotatable cam 35. Cable 52 is preferably composed of either a flat stiff mesh composition or a series of individual steel cables arranged to form a single flat cable, such that it has enough column strength to push piston 47 into driving position.

Motor/gear subassembly 55 comprises a central axial pin generally indicated at 60 having a head end 62 and an elongated shaft portion 64 rigidly affixed to frame 30 of tool main body 12 by a series of screw threads 66, or any other convenient means.

Figure 5:
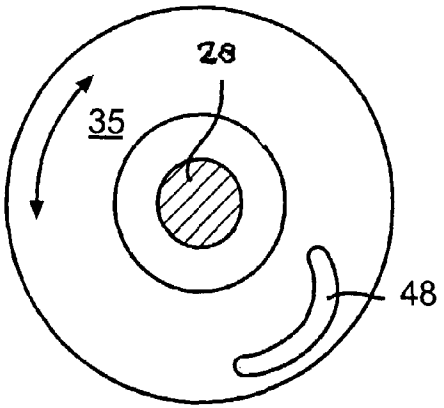
FIG. 5 is a cross-sectional view taken along section line 5—5 of FIG. 2.
Figure 6:
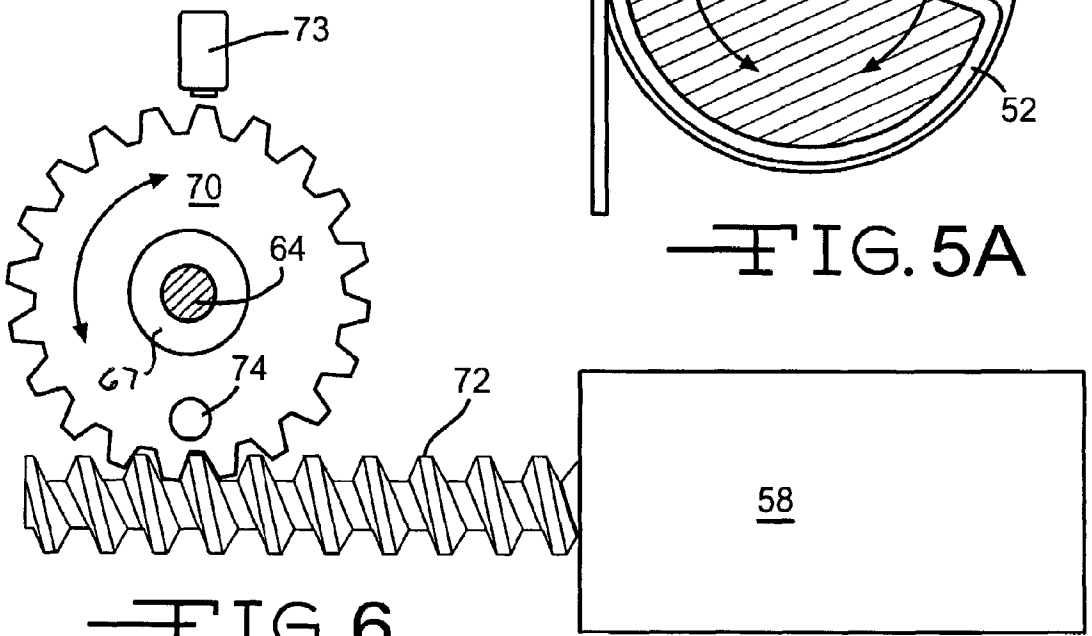
FIG. 6 is a cross-sectional view taken along section line 6—6 of FIG. 2.

Assembled coaxially upon axial pin 60 between pin head end 62 and main body frame 30 is a toothed drive gear 70. Suitable washers 67 and 68 are positioned on either side of drive gear 70, as illustrated in FIGS. 2 and 3. Drive gear 70 is driven by a motor 58 through a worm gear 72, as illustrated in FIG. 6. Extending axially from drive gear 70 is a drive pin 74. Extending axially outward from rotatable cam 35 is a cam lobe 48 as can be clearly seen in FIG. 5.

Figures 7A, 7B, 7C, 7D:
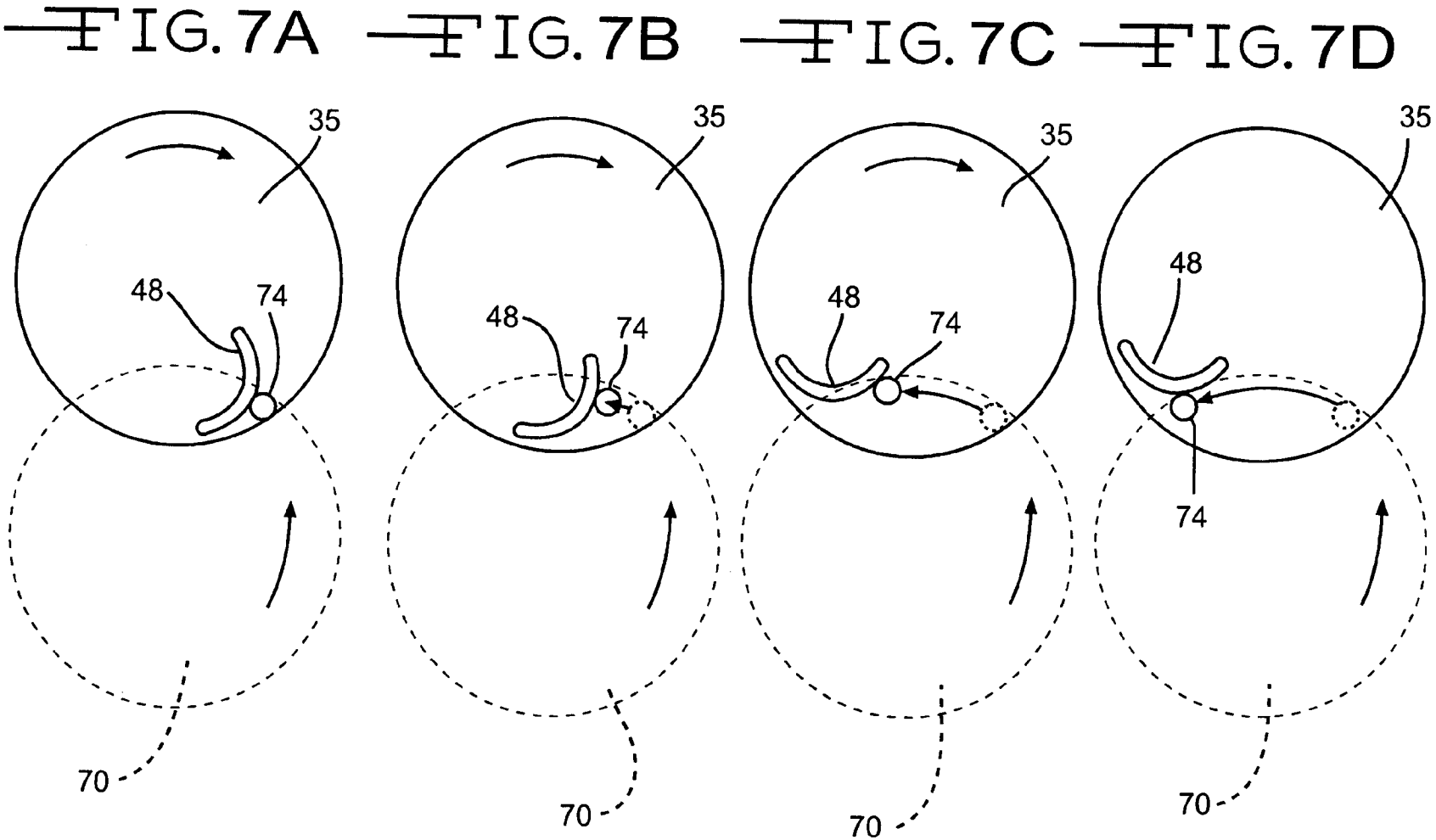
FIGS. 7A–D, taken together, show the operating sequence illustrating the engagement of the driving pin of the drive gear upon the cam lobe of the rotatable cam whereby the rotatable cam is rotated until disengagement of the driving pin from the cam lobe.

Referring now to FIGS. 7A–7D, as drive gear 70 is rotated counterclockwise by worm gear 72, drive pin 74, also rotating counterclockwise, engages cam lobe 48, as illustrated in FIG. 7A. As drive pin 74 continues its counterclockwise rotation, the action of drive pin 74 upon cam lobe 48 causes clockwise rotation of rotatable cam 35 as illustrated in FIGS. 7B and 7C. Upon disengagement of drive pin 74 from cam lobe 48, as illustrated in FIG. 7D, rotatable cam 35 is free to rotate in the counterclockwise direction and return to its initial resting position.

In operation, as rotatable cam 35 is rotated in a clockwise direction, as viewed in FIGS. 5, 5A, and 7A–D, driver activating cable 52 uncoils from the periphery of cam 35, thereby forcing driving piston 47, along with the attached fastener driver 50, upwardly, as viewed in FIG. 3, into piston tube 40. Further, as rotatable cam 35 rotates in a clockwise direction, the axial distance between rotatable cam 35 and non-rotatable cam 36 increases, by action of ball bearings 46 and opposing ball ramps 42 and 44 of rotatable cam 35 and non-rotatable cam 36, thereby compressing compressible spring means 38, storing potential energy therein.

Upon driving piston 47 reaching the top of its driving stroke, cam lobe 48 is released from drive pin 74, thereby permitting rotatable cam plate 35 to rotate about axial pin 25. The potential energy stored within compressed Belleville spring washers 22 now forces fixed cam plate 36 towards the left toward cam plate 35 (as viewed in FIGS. 1 and 2). As fixed cam plate 36 shifts to the left, the action of ball bearings 46 between ball ramps 42 and 44 causes rotatable cam plate 30 to rotate in the reverse direction as fixed cam plate 32 approaches rotatable cam plate 35.

As rotatable cam plate 35 rotates in the reverse direction, driver activating cable 52 now wraps about channel 26 within the periphery of rotatable cam 35, thereby pulling driver piston 47 and fastener driver 50 downwardly, driving a fastener from magazine 18 into a workpiece (not shown).

Figure 9:
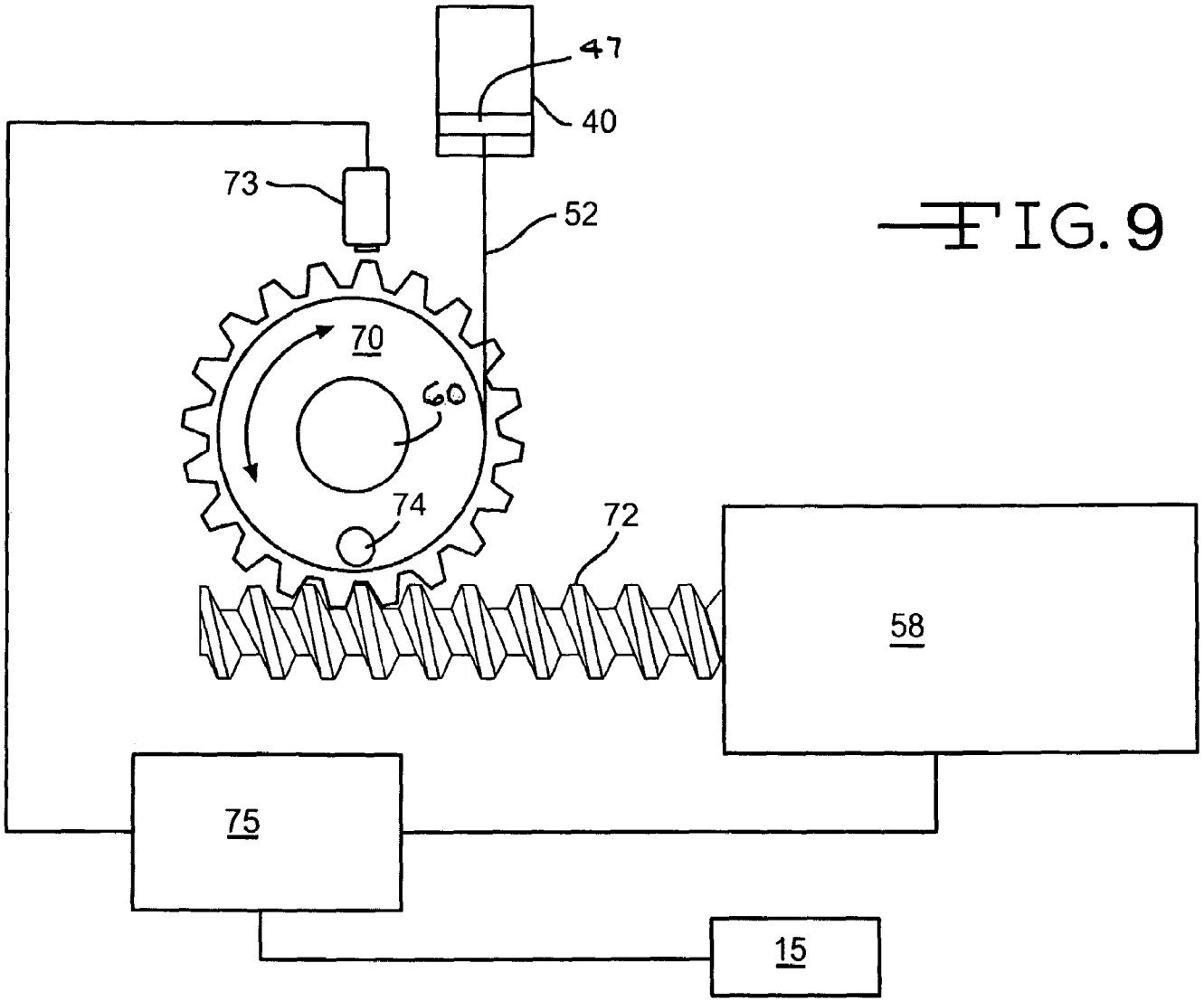
FIG. 9 is a block diagram of an electronic circuit for activating and controlling the fastener driving tool of the present invention.

FIG. 9 illustrates a simple control system for operating and controlling the herein described fastener tool 10. A magnetic sensor 73 may be conveniently positioned juxtaposed drive gear 70 as best illustrated in FIG. 6. A programmed electronic controller 75 may be conveniently positioned within main body 12 or handle 14 of fastener driving tool 10.

Controller 75 is programmed such that when the operator squeezes trigger 15 a signal is sent from trigger 15 to controller 75. Controller 75 then sends a signal to motor 58 to energize, thereby causing drive gear 70 to rotate. As drive gear 70 rotates, magnetic sensor 73 counts the number of gear teeth passing thereby. After sensing the passage of a given number of gear teeth, representing one full revolution of drive gear 70, controller 75 signals motor 58 to stop, thereby repositioning drive pin 74 at its starting position.

As the distance moved by cam 36 under the force of spring means 38 is very small when compared to the distance traveled by driver 50 in driving a fastener, a mechanical advantage is created by this mechanism. This allows the tool to be smaller, and also allows the tool to operate more quickly.

Although use of a tooth counting magnetic sensor is disclosed above, any other suitable means may be used to determine the desired revolution of drive gear 70. For example, a proximity sensor, optical or magnetic, might be used to sense the return of drive pin 74 to its start position. Further, any suitable mechanical sensing mechanism might be used to determine return of drive pin 74 to its start position.

Depending upon scale or size of the gear/drive subassembly 55, it may also be suitable to provide two or more drive pins equally spaced about drive gear 70 whereby one full cycle of the fastener drive subassembly 20 would comprise 180 degrees, or less, of drive gear 70.

Figure 10:
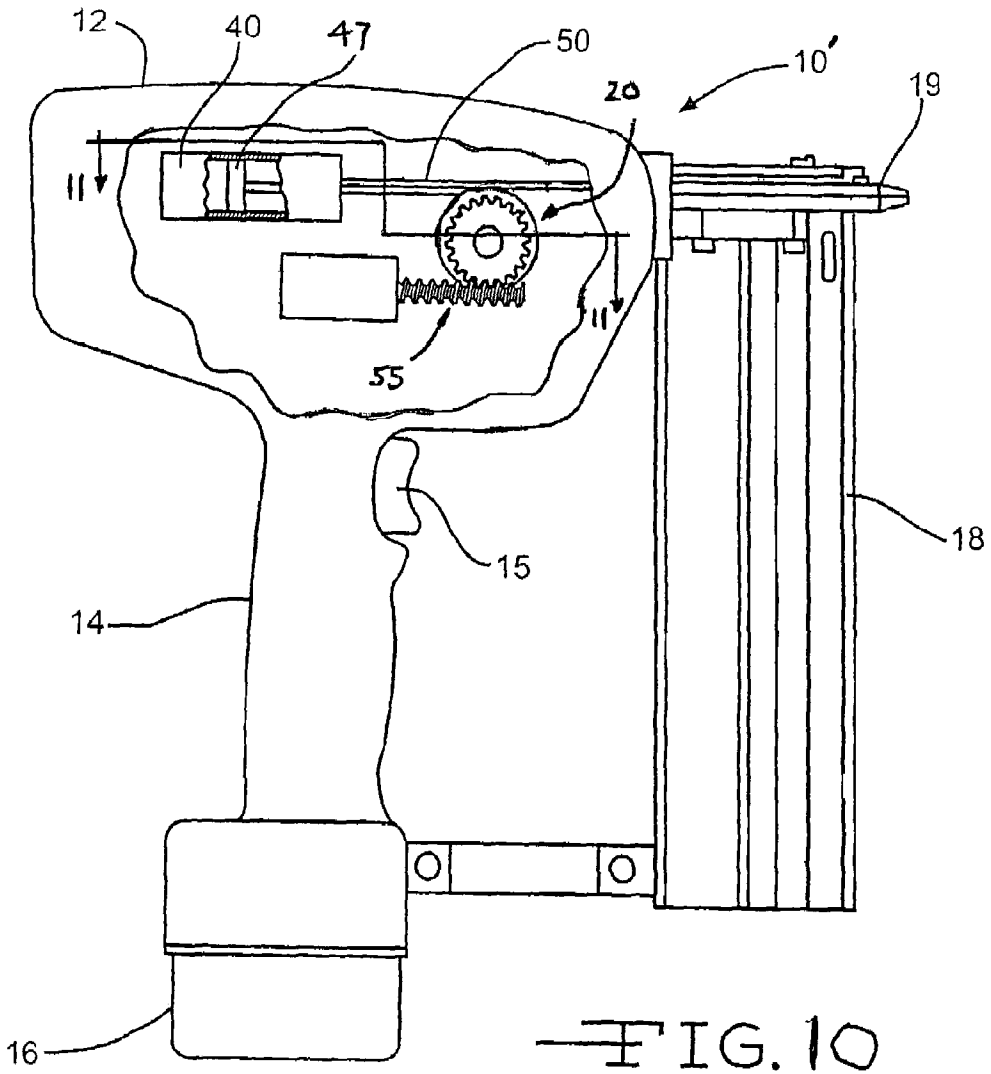
FIG. 10 is a fragmentary side elevational view similar to FIG. 1 of an alternate embodiment of the present invention.
Figure 11:
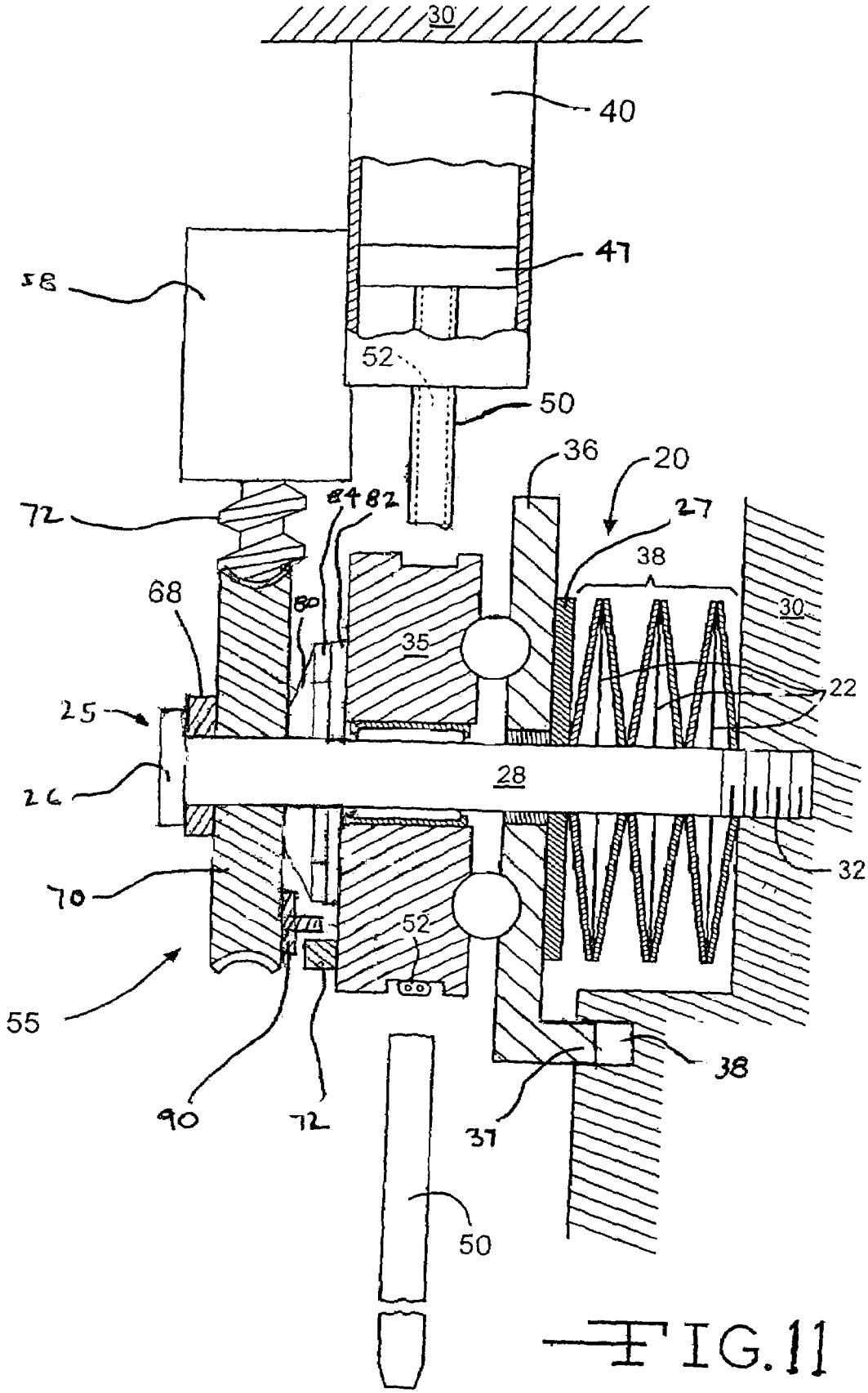
FIG. 11 is a cross-sectional view taken along section line 11—11 of FIG. 10 showing the principal working elements of this embodiment.
Figure 12:
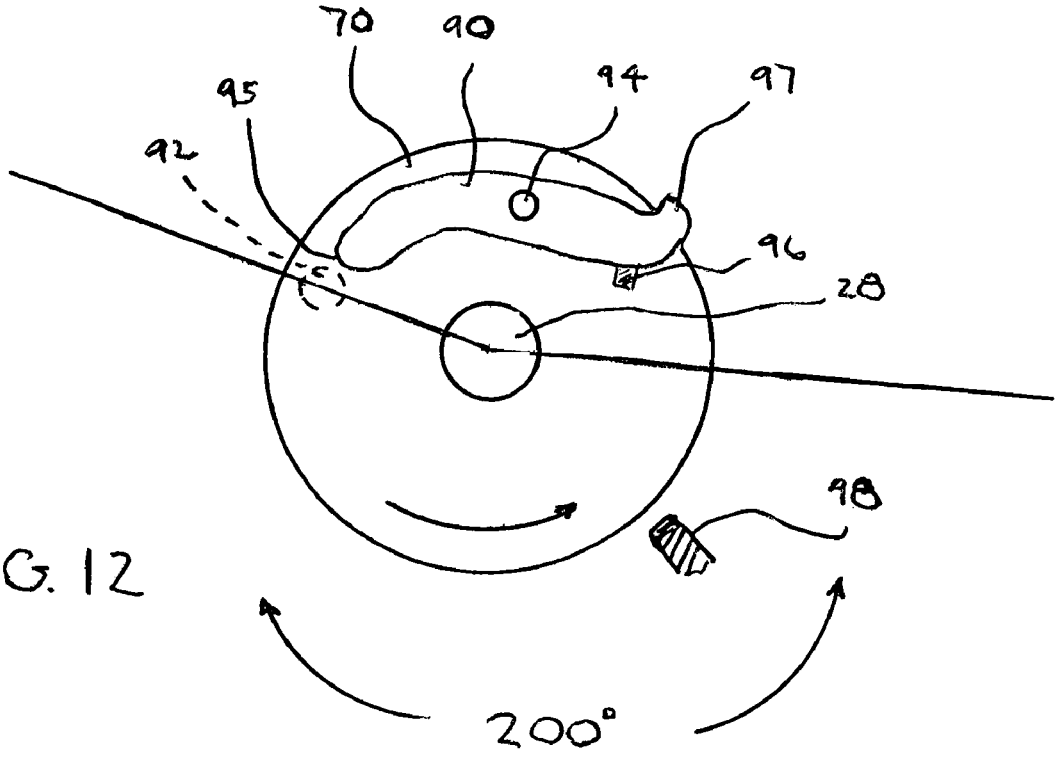
FIG. 12 is a front view of the drive gear for use in the alternative embodiment.

An alternative embodiment of the present invention is shown in FIGS. 10–12. Note that throughout these FIGS., like elements are designated with like numerals. Referring now to FIGS. 10 and 11, there is shown a fastener driving tool generally indicated at 10' in which fastener driving subassembly 20 and motor/gear subassembly 55 are located collinearly on a single axial pin designated at 25. Rotatable cam 35 is positioned along elongated shaft portion 28 between drive gear 70 and fixed cam 36. These components are held in place along pin 25 by washer 68 positioned between drive gear 70 and head end 26 of pin 25, a pair of spaces 80, 82 and a thrust washer 84 positioned between drive gear 70 and rotatable cam 35, bail bearings 46 between cam 35 and cam 36, and a spacer 27 between cam 36 and spring means 38 comprising a stack of Belleville spring washers 22, which contacts frame 30 of tool 10'. Pin 25 is affixed to frame 30 by threaded end 32.

Positioned on drive gear 70 on the side facing rotatable cam 35 is a latch mechanism 90, while positioned on cam 35 on the side facing gear 70 is a drive pin 92. Latch mechanism 90 is fixed for rotation about a pivot pin 94 and is biased by a spring 96 such that an edge 95 of latch 90 contacts drive pin 92 of cam 35 when drive gear 70 rotates, as can be clearly seen in FIG. 12. Latch 90 also includes an extension 97 which overhangs the edge of drive gear 70.

The operation of this alternative embodiment can now be described. When it is desired to drive a fastener, the tool user activates trigger 15 of tool 10', sending a signal to motor 58, which rotates worm gear 72. This action causes drive gear 70 to rotate in the counterclockwise direction as seen in FIG. 12. The edge of latch mechanism 90 engages drive pin 92 on rotatable cam 35, causing rotatable cam 35 to rotate in unison with drive gear 70. This action causes ball bearings 46 to compress Belleville spring washers 22, storing potential energy in fastener driving subassembly 20.

When pin 92 has rotated cam 35 approximately 200 degrees, extension 97 of latch mechanism 98 contacts a protrusion 98 which extends from frame 30, rotating latch 90 about pivot 94 and compressing spring 96. As latch mechanism 90 pivots, edge 95 is released from contact with drive pin 92 of cam 35, allowing the potential energy stored in spring means 38 to cause ball bearings 46 to rotate cam 35 in the opposite direction, activating a drive cycle of piston 47 and fastener driver 50 to drive a fastener from magazine 18.

In the above description, and in the claims which follow, the use of such words as "clockwise", "counterclockwise", "distal", "proximal", "forward", "rearward", "vertical", "horizontal", and the like is in conjunction with the drawings for purposes of clarity.

While the invention has been shown and described in terms of preferred embodiments, it will be understood that this invention is not limited to these particular embodiments, and that many changes and modifications may be made without departing from the true spirit and scope of the invention as defined in the appended claims.

What is claimed is:

1. A fastener driving tool, comprising:

a housing;

a fastener driver within said housing having a first at rest/fired position and a second firing position;

a fastener driving subassembly within said housing including compressible means for storing energy shiftable between an at rest position and an energized position;

a first cam plate rotatably mounted on a shaft capable of rotation in a first direction and a second opposite direction;

a means for driving the tool comprising a toothed gear wherein said toothed gear and said first cam plate have opposing surfaces;

wherein said toothed gear contains a drive pin and said first cam plate contains a cam lobe on said opposing surface such that said drive pin and said cam lobe engage each other to rotate said first cam plate in said first direction;

a motor/gear subassembly within said housing for compressing said means for storing energy and moving said fastener driver to said firing position;

such that when said motor/gear subassembly moves said fastener driver to said firing position, energy stored in said means for storing energy moves said fastener driver from said firing position to said fired position, whereby driving a fastener.

2. The tool of claim 1, wherein said means for storing energy comprises at least one Belleville spring washer.

3. The tool of claim 2, further comprising an actuation cable coupled between said fastener driver and aid fastener driving subassembly.

4. A tool for driving fasteners, comprising:

a power source;

a housing;

a fastener containing magazine attached to said housing;

a motor, located within said housing, operated by said power source;

a trigger for controlling said motor;

a shaft, fixed within said housing;

a first cam plate rotatably mounted on said shaft capable of rotation in a first direction and a second opposite direction;

a second cam plate, fixed against rotation on said shaft and coaxial with said first cam plate and shiftable axially on said shaft between a first position and a second position;

a fastener driver, connected to said first cam plate and shiftable between an at rest/driven position and a second driving position; means for selectively coupling said first cam plate and said second cam plate;

compressible means for storing energy, coupled on said shaft between said second cam plate and said housing, shiftable between a first at rest position and a second energized position;

and means for driving said tool, comprising a toothed gear, activated by said motor and selectively coupled to said first cam plate, wherein said toothed gear and said first cam plate have opposing surfaces;

such that when said trigger is activated, said motor activates said means for driving said tool and rotates said first cam plate in said first direction, shifting said second cam plate linearly from said first position to said second position and shifting said means for storing energy from said first at rest position to said second energized position while simultaneously shifting said fastener driver from said at rest position to said second driving position, wherein said means driving said tool decouples from said first cam plate, causing said means for storing energy to rotate said first cam plate in said second opposite direction, and shifting said fastener driver from said driving position to said driven position, driving a fastener from said magazine, wherein said toothed gear contains a drive pin and said first cam plate contains a cam lobe on said opposing surfaces such that said drive pin and said cam lobe engage each other to rotate said first cam plate in said first direction.

5. The tool of claim 4, wherein said means for storing energy comprises at least one Belleville spring washer.

6. The tool of claim 4, wherein said means for storing energy comprises a plurality of Belleville spring washers.

7. The tool of claim 4, wherein said fastener driver is connected to said first cam plate by a flat stiff mesh cable which is wound around the periphery of said first cam plate.

8. The tool of claim 7, wherein said fastener driver is pushed from said at rest position to said driving position by said flat stiff mesh cable.

9. The tool of claim 4, wherein said motor activates said means for driving said tool using a worm gear.

10. The tool of claim 4, wherein said first and second cam plates have opposing surfaces, with each of said surfaces having a plurality of correspondingly opposing ramps within said surface.

11. The tool of claim 10, wherein said means for coupling said cam plates together comprises a ball bearing located within each of said ramps.

12. The tool of claim 4, wherein said power source comprises a portable battery which is removably coupled to said housing.

13. The tool of claim 4, wherein said toothed gear contains a latch mechanism and said first cam plate contains a drive pin on said opposing surfaces such that said drive pin and said latch mechanism engage each other to rotate said first cam plate in said first direction.

14. The tool of claim 13, wherein after said first cam plate has rotated in said first direction for a set amount of rotation, said drive pin and said latch mechanism disengage.

15. The tool of claim 14, wherein upon disengagement of said drive pin and latch mechanism, said means for storing energy shifts said second cam plate from said second position to said first position, causing said means for coupling said cam plates together to rotate said first cam plate in said second opposite direction.

16. The tool of claim 14, further comprising a protrusion extending from said housing which contacts said latch mechanism to disengage said latch mechanism from said drive pin.

17. The tool of claim 4, wherein said means for driving said tool, said first cam plate, said second cam plate, and said means for storing energy are located co-linearly on said shaft.

18. The tool of claim 17, wherein said set amount of rotation comprises 200 degrees.

19. The tool of claim 4 wherein after said first cam plate has rotated in said first direction for a set amount of rotation, said drive pin and said cam lobe disengage.

20. The tool of claim 4, wherein said means for storing energy comprises a coil spring.

21. In a fastener driving tool, a fastener driving mechanism, comprising:

a) a frame;

b) a central shaft affixed to said frame;

c) a first non-rotatable axially slidable cam positioned upon said central shaft and having a toothed gear opposing said first cam;

d) a compressible potential energy storing means positioned between said non-rotatable cam and said frame;

e) a second non-axially translatable cam rotatably positioned upon said central shaft, whereby said first and second cam having opposing surfaces;

f) said first and second cams having at least three correspondingly opposing ball ramps within each of said opposing surfaces, wherein said toothed pear contains a drive pin and said first cam plate contains a cam lobe on said opposing surface such that said drive pin and said cam lobe engage each other to rotate said first cam plate in said first direction;

g) a cam ball positioned within each set of opposing ball ramps, whereby rotation of said second cam, in a first direction causes said first cam to axially translate away from said second cam and rotation of said second cam in the opposite direction permits said first cam to axially translate towards said second cam;

h) a fastener driving member;

i) an actuation cable having a first end affixed to said fastener driving member and its opposite, second end, affixed to the periphery of said second cam, whereby a portion of said actuation cable is wrapped about the periphery of said second cam;

j) a motor drive assembly for rotating said second cam about said central shaft, whereby said second cam causes said first cam to translate away from said second cam, thereby compressing said means for compressing for potential energy storage while simultaneously causing said actuation cable to unwrap from the periphery of said second cam thereby positioning said fastener driving member into its fastener driving configuration, whereupon release of said rotatable cam from said motor drive assembly causes said means for compressing for potential energy storage to cause rotation of said rotatable cam in the reverse direction, thereby rewrapping said activation cable about said rotatable cam's periphery and driving the fastener driver whereby said driver drives a fastener into a workpiece.

22. The fastener driving mechanism of claim 21, wherein said compressible means for storing energy comprises at least one Belleville spring washer.

23. The fastener driving mechanism of claim 22, wherein at least one Bellville spring washer is coaxial with said central shaft.

24. The fastener driving mechanism of claim 21, wherein said compressible means for storing energy comprises at least one coil spring.

25. The fastener driving mechanism of claim 24, wherein said coil spring coaxial with said central shaft.

26. The fastener driving mechanism of claim 21, further comprising means for monitoring the rotation of said toothed drive gear.

* * * * *